US005884817A

United States Patent [19]

Kaufman et al.

[11] Patent Number: 5,884,817

[45] Date of Patent: Mar. 23, 1999

[54] TILT DISPENSER

[75] Inventors: John G. Kaufman, Burlington; Edmond L. Rampen, Oakville, both of Canada

[73] Assignee: Kaufman Products Inc., Oakville, Canada

[21] Appl. No.: 790,662

[22] Filed: Jan. 30, 1997

[51] Int. Cl.[6] ..... B65D 37/00

[52] U.S. Cl. ..... 222/212; 222/185.1; 222/207

[58] Field of Search ..... 222/185.1, 207, 222/209, 212, 457, 478, 479, 442, 464

[56] References Cited

U.S. PATENT DOCUMENTS

| | | | |
|---|---|---|---|
| 1,995,215 | 3/1935 | Mehlsen et al. . | |
| 2,680,010 | 6/1954 | Dubay | 261/124 |
| 3,422,993 | 1/1969 | Boehm et al. | 222/190 |
| 3,622,049 | 11/1971 | Thompson | 222/190 |
| 3,709,437 | 1/1973 | Wright | 239/343 |
| 3,985,271 | 10/1976 | Gardner | 222/190 |
| 4,018,364 | 4/1977 | Wright | 222/190 |
| 4,022,351 | 5/1977 | Wright | 222/145 |
| 4,147,306 | 4/1979 | Bennett | 239/327 |
| 4,184,615 | 1/1980 | Wright | 222/190 |
| 4,324,349 | 4/1982 | Kaufman | 222/207 |
| 4,429,834 | 2/1984 | Ito | 239/327 |
| 4,432,496 | 2/1984 | Ito | 239/327 |
| 4,635,828 | 1/1987 | Kaufman | 222/185 |
| 4,645,097 | 2/1987 | Kaufman | 222/207 |
| 4,957,218 | 9/1990 | Ford, Jr. | 222/1 |
| 5,033,653 | 7/1991 | Kaufman | 222/185 |
| 5,060,830 | 10/1991 | Krall | 222/212 |
| 5,217,147 | 6/1993 | Kaufman | 222/185 |
| 5,427,279 | 6/1995 | Kaufman | 222/207 |
| 5,544,788 | 8/1996 | Meyer | 222/110 |
| 5,590,817 | 1/1997 | Kaufman | 222/185.1 |

*Primary Examiner*—David J. Walczak
*Assistant Examiner*—Timothy L. Maust
*Attorney, Agent, or Firm*—Rogers & Scott

[57] ABSTRACT

The invention provides dispensers for liquids having a dispensing opening in the side of the dispenser and liquid is stored in a main body of a resiliently deformable container coupled to a neck structure which has a bottom outlet inside a base structure. In use, the dispenser is first lifted and then tilted through about 30 to 50 degrees before squeezing the container. The tilting action causes some of the air in the base structure to be trapped thereby minimizing the effect of temperature compensation on response rate. Consequently, the squeezing action is immediately available to force liquid to pass through the base structure and issue from the side dispensing opening. Various structures can be made consistent with the invention to accommodate a range of liquids having different properties.

14 Claims, 2 Drawing Sheets

TILT DISPENSER

FIELD OF THE INVENTION

This invention relates to dispensers for liquids of the type sold in smaller quantities for subsequent use domestically. More particularly the invention provides such dispensers which are operated by tilting the dispenser so that subsequent squeezing will cause dispensing downwardly through a dispensing opening in the side of the dispenser.

BACKGROUND OF THE INVENTION

Many consumer products in liquid form are sold in smaller containers from which the user periodically pours or dispenses a small amount of the liquid. Typical liquids are shampoo, liquid soaps, dishwashing detergent, soya sauce, mineral oils, etc. Such liquids are sold very competitively and consequently the products are often sold in inexpensive bottles having some form of closure or simple dispensing pump.

The user will periodically require liquid from the container and it would be preferable for the container to be easy to use with no dripping or dribbling. Existing containers of this type exit through a top closure or pump. In the case of a simple closure the user inverts the container to get liquid to flow towards the closure before liquid will emerge. There is therefore a tendency for an apparently empty container to have a significant amount of liquid remaining on the walls of the container.

The pump system is intended to be used with the container supported so that the pump is depressed downwardly with the container providing the reactive load. These structures are very difficult to empty and tend to drip or dribble.

It has been found that the above disadvantages can be largely overcome by the present invention which takes advantage of principles taught in U.S. Pat. Nos. 4,324,349; 4,635,828; 4,645,097; 5,033,653; and 5,427,279 to Kaufman all of which are examples of what have become known as "Kaufman dispensers". These patents teach dispensers which have no moving parts and yet satisfy the requirements of clean dispensing with temperature compensation to permit the dispenser to be subjected to a designed temperature range without significant inadvertent dripping or dispensing caused by temperature variations.

The structures shown in the Kaufman patents have a reservoir for liquid to be dispensed in communication with a main part of the dispenser in the form of a container where the major volume of the liquid is contained. Air is trapped above the liquid in the container under a negative pressure which prevents the liquid flowing from the container into the reservoir and out through a discharge passageway. Dispensing can be initiated in several ways. For instance embodiments are provided in the earlier patents which are caused to dispense by squeezing the container. The resiliently deformable container rebounds to its original shape when squeezing is discontinued so that air is sucked back into the passageway and the container is set up in a new condition of equilibrium.

There are two significant parameters present in such dispensers. Firstly the reservoir is designed to provide space for the liquid level in the reservoir to rise when ambient temperature rises. Secondly the reservoir and discharge structure are designed to provide quick response to the dispensing action. Previous Kaufman patents have described these parameters in detail, but in general it has been found that the parameters work against one another because the response time increases as the temperature compensation volume increases.

Special structures can be used to overcome this problem if needed but such structures are not as effective in smaller dispensers of the present type.

It is therefore desirable to provide a dispenser for smaller volumes of liquid which is ergonomically acceptable and which, in operation, minimizes the effects of the aforesaid conflicting parameters.

SUMMARY OF THE INVENTION

The invention provides dispensers for liquids having a dispensing opening in the side of the dispenser and liquid is stored in a main body of a resiliently deformable container coupled to a neck structure which has a bottom outlet inside a base structure. In use, the dispenser is first lifted and then tilted through about 30 to 50 degrees before squeezing the container. The tilting action causes some of the air in the base structure to be trapped thereby minimizing the effect of temperature compensation on response rate. Consequently, the squeezing action is immediately available to force liquid to pass through the base structure and issue from the side dispensing opening. Various structures can be made consistent with the invention to accommodate a range of liquids having different properties.

Advantages include the fact that between dispensing events, all liquid will flow off the walls of the container so that eventually the base structure will contain the remaining liquid in a concentrated space to facilitate emptying the container completely. Also, the dispenser is simple to construct and resists tendencies to drip or dribble.

BRIEF DESCRIPTION OF THE DRAWINGS

The invention will be better understood with reference to the drawings, in which.

Figure 1:
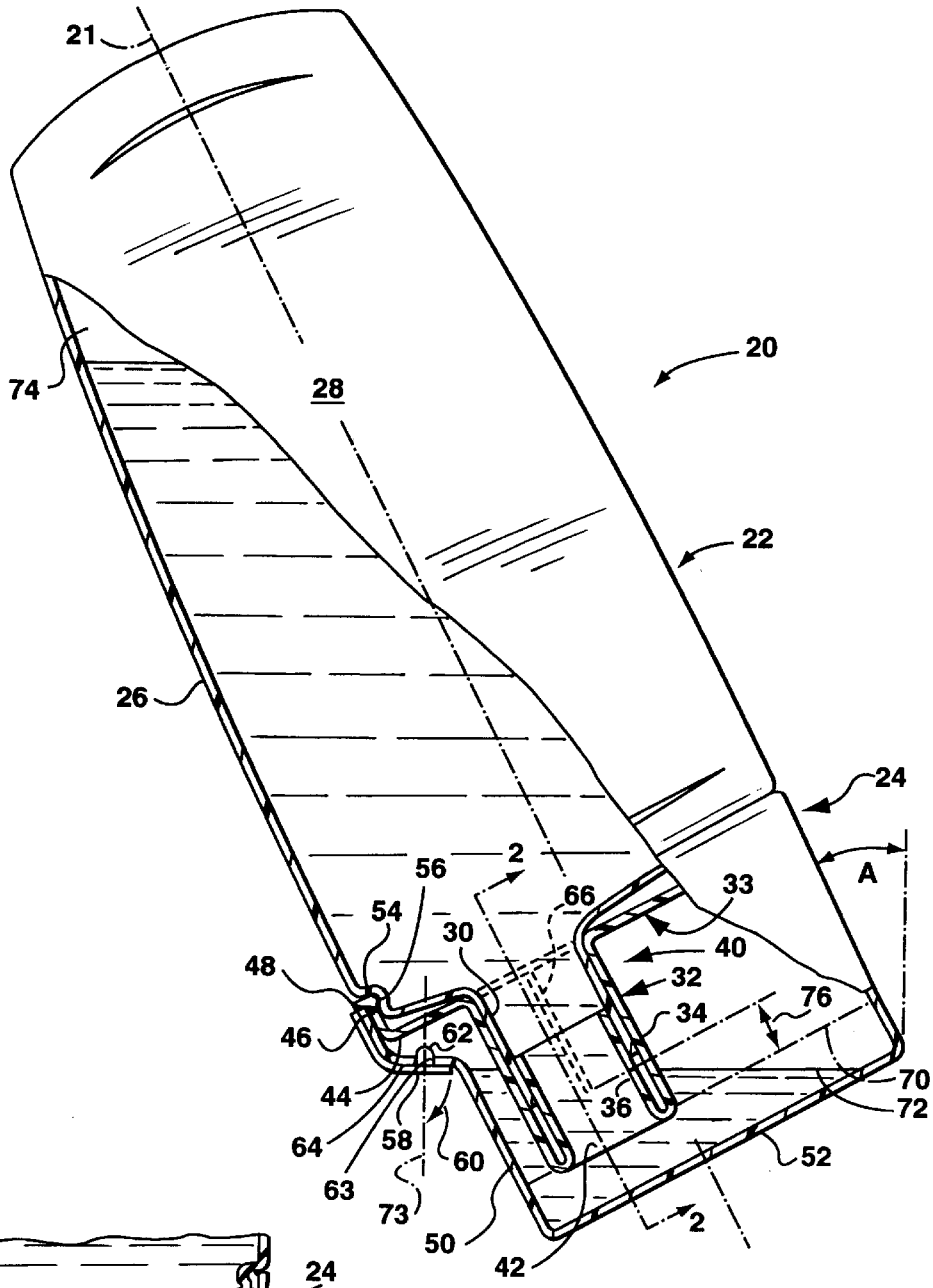
FIG. 1 is a side view, partially in section, and showing a preferred embodiment of the invention tilted into a position ready for dispensing, this embodiment being particularly useful for dispensing liquids having lower viscosity.

Reference is first made to FIG. 1 to describe a preferred embodiment of the invention. A dispenser designated generally by the numeral 20 normally stands upright but is illustrated in FIG. 1 with the main axis 21 of the dispenser tilted through an angle "A" ready for dispensing. The reasons for this position will be more fully described once details of the structure have been explained.

The dispenser 20 consists essentially of a container 22 which is coupled to a base structure 24. The container 22 includes a main body 26 which is generally oval in cross-section and exhibits a pair of generally opposed surfaces 28, one of which is seen. The main body extends downwardly terminating in a cylindrical extension or neck 30 which is engaged into an insert 33 having cylindrical receiver 32 including a downwardly extending outer wall 34 which reverses to form an inner wall 36. The neck 30 is a sealing fit between the cylindrical outer wall 34 and the cylindrical inner wall 36 to form a neck structure indicated generally by the numeral 40. This neck structure terminates at a bottom opening 42 through which liquid from the main body 26 will fall under the influence of gravity.

The insert 33 includes a platform 44 from which the cylindrical receiver 32 depends and the platform extends outwardly to a peripheral flange 46 terminating at an outwardly extending lip 48. The flange 46 is shaped to be a close fit within an upper portion of a peripheral wall 50 of the base structure 24 and the insert 33 is retained in position by welding the outwardly extending lip 48 to the upper extremity of the peripheral wall 50. The peripheral wall extends downwardly to meet a bottom 52 of the base structure 24. As a result, the volume contained between the bottom 52, the peripheral wall 50, and the insert 33 is sealed and is in communication only with the contents of the main body 26 of the container 22.

The main body 26 is shaped where it meets the insert 33 to be a snap fit on the insert. To this end, the main body includes a peripheral recess 54 receiving a rib 56 formed on the inside of the flange 46. It will be appreciated that this seal does not need to be air tight since it is an auxiliary connection with the main seal taking place between the neck 30 of the container 22 and the cylindrical receiver 32 of the insert 33.

A snap fitting closure 58 is moulded with the peripheral wall 50 and is connected by a living hinge 59 so that the closure can be moved above the hinge in the direction of the arrow 60. This action causes a short projection 62 to move out of an outlet 63 formed in a dispensing portion 64 of the peripheral wall 50. The closure must of course be released and moved out of the way before dispensing can take place and then returned should the user wish to seal the dispenser.

Figure 2:
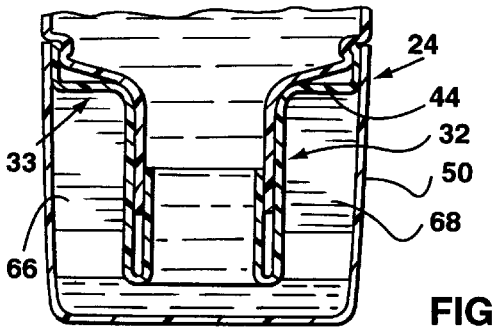
FIG. 2 is a sectional view on line 2—2 of FIG. 1 and showing a part of the dispenser.

Reference is next made to FIG. 2 which illustrates further structure not readily seen in FIG. 1. FIG. 2 is a sectional view on line 2—2 and it will be seen in FIG. 2 that the neck structure 40 is associated with a pair of separators 66, 68 which are aligned with one another and attached to the insert 33. The separators are in contact with the peripheral wall 50 of the base structure 24 in order to combine with the neck structure to create a dam. As seen in FIG. 1, the separator 66 is shown in broken outline and to the left of the separator as drawn there is a first volume created and to the right a second volume. The separators project downwardly from the platform 44 of the insert 33 and terminate above the bottom 52.

When the dispenser is in a rest position, it will stand on the bottom 52 with the main axis of the upright dispenser vertical. The user will first open the closure 58 to expose the outer 63 and then place the dispenser in the tilted position shown in FIG. 1. In doing so, liquid which was previously at a liquid level shown in ghost outline at 70 will naturally flow into a position shown in full outline by the line 72. As this motion takes place, the liquid continues to submerge the bottom opening 42 and comes into contact with the separators 66, 68 thereby trapping air in the second volume shown in FIG. 1 to the right of the separators 66 and 68 (FIG. 2). The importance of this movement of liquid in relation to the volume of air trapped will now be described.

With the dispenser in the rest position, and liquid at the level 70, there is room for temperature compensation with the closure 58 open. In the event that temperature increases, then air trapped in the container 22 is above the liquid in a volume 74 at the top of the main body 26. The air will be affected by an increase in temperature with the result that liquid will flow downwardly from the main body 26. This flow of liquid causes the level 70 to rise until it meets the separators 66, 68. Consequently, there is temperature compensation across the full cross-section of the base structure until this point is reached. Should there be further increase in temperature, air to the right of the separator 66 will be trapped and consequently resist further compression. Liquid will then flow upwardly to the left of the separators towards the outlet opening at the closure 58. There is therefore two parts to the temperature compensation. First of all the full cross-section is available until liquid meets the separators and then a reduced cross-section is available until liquid meets the opening at which there will be some involuntary dispensing.

If the user attempts to dispense with the dispenser in a rest position, then the user must move enough liquid from the main body 26 into the base structure 24 to bring the level 70 up to the underside of the separator 66, i.e. an increase in height equivalent to that indicated by the numeral 76. However, this product is intended to be ergonomically acceptable as a tilt and squeeze product. Consequently, the user will naturally pick up the dispenser, angle it until the outlet 63 is facing downwardly, as shown in FIG. 1, (i.e. the dispensing portion 64 is essentially horizontal) and then squeeze. When this dispensing position is achieved by simply tilting the dispenser, the dam has met the liquid and the volume to the right of the separator 66 is sealed. Consequently as soon as the user squeezes, all of the effort will go into moving liquid the short distance from the level 72 to the outlet in the dispensing portion 64. There is then a sudden response. The temperature compensation has effectively been separated from the need for a short response time.

The angle "A" should be in the range of 30 to 50 degrees for normal use. The dispensing portion 64 is shaped correspondingly so that it will be essentially horizontal at the time of dispensing to minimize the likelihood of liquid dribbling as it is dispensed. To achieve this, the angle between the portion 64 and the main axis 21 will be (90-A) degrees or preferably in the range 40 to 60 degrees. Similarly, the angle of an outlet axis 73 of the opening 63 will be A, or 30 to 50 degrees relative to the main axis 21. It has been found that with these parameters, the liquid will dispense without dribbling and that once the user releases the dispenser, air will be sucked back into the dispenser to clean out the dispensing opening and remove liquid from the dispensing portion 64. As air is sucked back there will of course be a compensation made for the liquid that has been dispensed and a new level 70 will be achieved together with an increase in the volume of air indicated at 74.

The structure shown in FIG. 1 lends itself to use with a variety of liquids due to the fact that the insert 33 can be modified to change the position of the bottom opening 42. However, in circumstances where simplicity is paramount, then a structure such as that shown in FIG. 3 can be used. It will be seen that a container 80 is attached to a base structure 82 and that the container includes a neck structure 84 developing a liquid level 86 as liquid falls from the main body of the container. Separators 88 are provided in a similar fashion to separators 66, 68 shown in FIG. 2 in order to create volume to both sides of the separators. Otherwise the action of this dispenser will be the same as that described with reference to FIG. 1.

Figure 3:
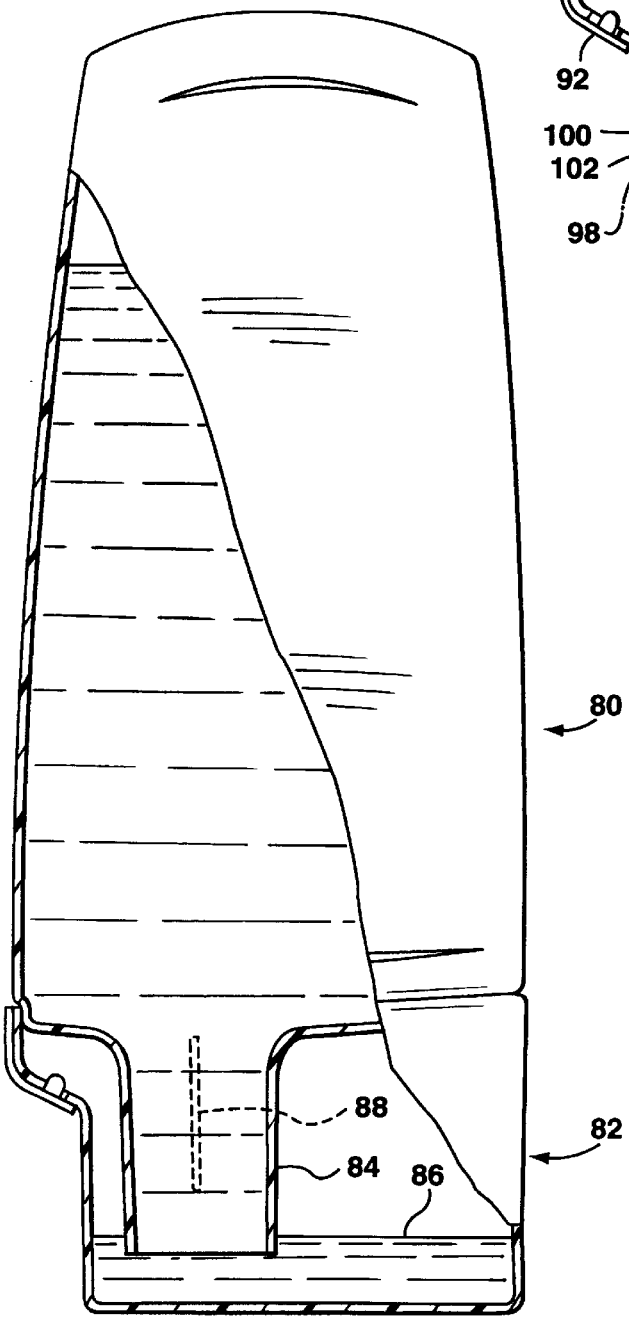
FIG. 3 is a view similar to FIG. 1 and illustrating a second embodiment of the dispenser also for use with lower viscosity liquids and shown at rest in an upright position.

It will be appreciated that the position of the neck 84 shown in FIG. 3 and its relation to the separator 88 will affect the operation of the dispenser. It should be remembered however that the separators in fact are part of a dam which includes the neck 84.

Figure 4:
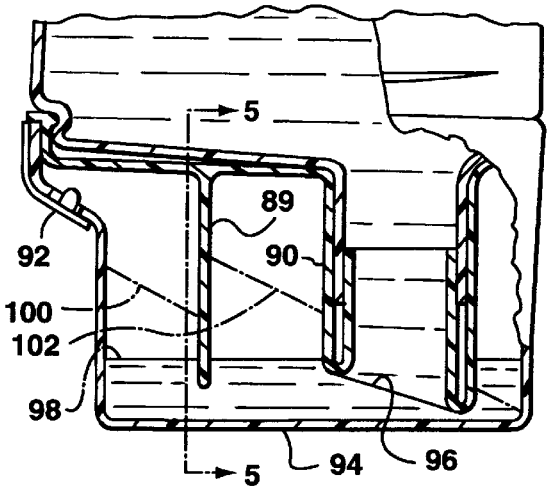
FIG. 4 is a sectional view similar to FIG. 3 and showing part of the dispenser incorporating structure to be preferred when dispensing more viscous liquids.

Reference is next made to FIG. 4 which illustrates a separate dam 89 and neck structure 90. In this case the neck structure is shown separated from a closure 92 and associated outlet opening and the dam 89 is positioned between the neck structure 90 and the closure 92. Also, in this case the dam extends downwardly towards a bottom 94 falling short of the bottom but approximating the height of an angled bottom opening 96. In the rest position, liquid reaches a level 98 and when the dispenser is tilted, liquid will form two liquid levels indicated in ghost outline at 100, and at 102. The reason for this is that because the dam is engaged in the liquid in the rest position, there will be a tendency for some of the liquid to ride up the dam when the dispenser is tilted. To ensure that the bottom opening 96 remains immersed, it is angled to generally match the new level 102.

Figure 5:
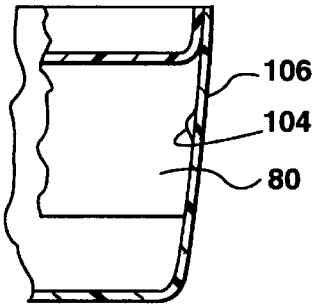
FIG. 5 is a sectional view on line 5—5 of FIG. 4 and showing a part of the dispenser.

It will be clear that the structure described with reference to FIG. 4 will have temperature compensation only in the volume drawn to the left of the dam 88 because the air to the right will be trapped. However, this is compensated by providing an opening around the dam as illustrated in FIG. 5. Here it will be seen that the dam 88 defines a small opening 104 where it meets a peripheral wall 106. The opening is positioned so that when the liquid level 102 is reached, the liquid will cover the opening 104 thereby blocking air movement. However, when the dispenser is in the rest position, the opening 104 will permit air flow so that the spacing between the level 98 and the opening 104 will provide adequate temperature compensation. Consequently, this structure operates in a similar fashion from the standpoint of separating temperature compensation from response time to that shown in FIG. 1. It has been found that a structure such as that shown in FIG. 4 has advantages when using the more viscous liquid whereas the structure shown in FIG. 1 is suitable for lower viscosity liquids.

It will be appreciated that the structure shown in FIG. 5 could also be used in FIG. 1. The result would be to increase the measurement 76 to extend from the level 70 to the opening in the dam. In use air would flow from the right of the dam (as drawn) until liquid reaches the hole and effectively seals it. Such an arrangement will affect the response time because some of the squeezing action is simply moving liquid in the base structure. Consequently, the level of the hole can be used to vary the response time if required for a particular design.

The structures described can be made from any suitable material exhibiting strength and flexibility as required for the operation of the dispenser. Such materials will be evident to those skilled in the art.

The structures described and claimed can be varied significantly within the scope of the invention and all such variations are intended to be within the scope of the claims.

We claim:

1. A dispenser for liquids having:

a resiliently deformable main body extending about a main axis;

a neck structure extending downwardly from the main body and terminating at a bottom opening, the main body being adapted to contain liquid to be dispensed;

a base structure coupled to the main body and having a bottom adapted to support the dispenser in an upright position with said axis vertical when placed on a horizontal surface, and a peripheral wall including a dispensing portion spaced above the bottom wall and defining an outlet having an outlet axis extending at an angle of about 40 to 60 degrees relative to said main axis;

a dam inside the base structure and extending downwardly terminating above the bottom wall, the dam being coupled to at least one of the main body and the base structure to divide an upper part of the base structure into first and second volumes; and the base structure being adapted to receive liquid from the main body such that with the dispenser tilted so that the outlet faces downwardly with said outlet axis substantially vertical, liquid in the base will define a liquid surface extending from adjacent said dispensing portion and containing said bottom opening and meeting the dam to close said first volume to limit entry of liquid whereby on squeezing the main body liquid will flow from the main body through the bottom outlet, into said second volume, and issue from the dispensing outlet.

2. A dispenser as claimed in claim 1 in which the dam is attached to the neck structure.

3. A dispenser as claimed in claim 1 in which the dam is positioned between the neck structure and the dispensing face.

4. A dispenser for liquids having:

a resiliently deformable main body extending about a main axis;

a neck structure extending downwardly from the main body and terminating at a bottom outlet;

a base structure coupled to the main body and containing the bottom outlet; the base structure having a bottom wall and a dispensing portion above the bottom wall defining a side outlet having an outlet axis extending at an angle of about 40 to 60 degrees relative to said main axis;

the base structure receiving a predetermined volume of liquid from the dispenser with the dispenser in a rest position in which the base structure is standing on a horizontal surface with the main axis vertical, the liquid flowing from the main body through the bottom outlet until the bottom outlet is immersed in liquid sufficient to stop flow from the main body; and the base structure being shaped to contain said predetermined volume of liquid immediately adjacent the dispensing portion with the dispenser tilted from said rest position through about 30 to 50 degrees into a dispensing position in which said outlet axis is generally vertical and the bottom outlet of the neck structure remains in the liquid.

5. A dispenser as claimed in claim 4 in which the dispenser further includes a dam inside the base structure and extending downwardly terminating above the bottom wall, the dam being attached to at least one of the main body and the base structure and dividing an upper part of the base structure into first and second volumes whereby on tilting the dispenser into said dispensing position and squeezing the main body, liquid in contact with the dam will close said first volume to minimize entry of liquid and liquid will flow from the main body into said second volume and issue from the outlet.

6. A dispenser as claimed in claim 5 in which the dam is attached to the neck structure.

7. A dispenser as claimed in claim 5 in which the dam is positioned between the neck structure and the dispensing face.

8. A dispenser for liquids having:

a main body extending about a main axis;

a neck structure extending downwardly from the main body and terminating at a bottom opening;

a base structure coupled to the main body and having a bottom adapted to support the dispenser on a horizontal surface and a peripheral wall extending between the bottom and the main body;

the base structure having an angled dispensing portion in the peripheral wall adjacent said main body, the dispensing portion defining a side opening having an outlet axis extending at an angle of about 40 to 60 degrees relative to said main axis;

the bottom opening being adjacent said bottom and below the side opening;

a dam extending downwardly from the main body and extending between parts of the peripheral wall, the dam terminating above the bottom and below the side opening whereby the dispenser can be actuated by tilting the dispenser until the side opening faces downwardly with the outlet axis generally vertical and then squeezing the main body.

9. A dispenser as claimed in claim 8 in which the dam is attached to the neck structure.

10. A dispenser as claimed in claim 8 in which the dam is positioned between the neck structure and the dispensing face.

11. A dispenser as claimed in claim 8 in which the bottom outlet is adjacent the peripheral wall below the dispensing portion.

12. A dispenser as claimed in claim 8 in which the dispensing outlet and the bottom outlet are on the same side of said main axis.

13. A dispenser as claimed in claim 8 in which the dispensing outlet and bottom outlet are not on the same side of said main axis.

14. A dispenser as claimed in claim 8 in which the dispensing outlet and the bottom outlet are on opposite sides of said main axis.

* * * * *